US005931607A

United States Patent [19]

Hess

[11] Patent Number: 5,931,607

[45] Date of Patent: Aug. 3, 1999

[54] LINING DEVICE

[76] Inventor: Wilhelm Hess, Alstadstrasse 77, D-51379 Leverkusen, Germany

[21] Appl. No.: 09/096,603

[22] Filed: Jun. 12, 1998

[51] Int. Cl.[6] ..... E02D 5/00

[52] U.S. Cl. ..... 405/282; 405/272

[58] Field of Search ..... 405/282, 283, 405/272, 273

[56] References Cited

U.S. PATENT DOCUMENTS

| | | | |
|---|---|---|---|
| 2,908,140 | 10/1959 | Everson | 405/283 |
| 3,950,952 | 4/1976 | Krings | 405/232 |
| 4,376,599 | 3/1983 | Krings | 405/282 |
| 4,657,442 | 4/1987 | Krings | 405/282 |
| 5,310,289 | 5/1994 | Hess | 405/282 |
| 5,503,504 | 4/1996 | Hess et al. | 405/282 |

FOREIGN PATENT DOCUMENTS

| | | | |
|---|---|---|---|
| WO84/00572 | 2/1984 | European Pat. Off. | 405/283 |

*Primary Examiner*—Dennis L. Taylor
*Attorney, Agent, or Firm*—Foley, Hoag & Eliot LLP

[57] ABSTRACT

The invention concerns a device for lining a trench, hole, tunnel or other excavation, said lining device comprising vertical supports arranged in pairs opposite one another on both sides along the trench, wherein the supports have first guide channels for receiving the lining plates on both of their sides and second guide channels located on the inside of said supports for guiding a bracing frame, wherein said second guide channels define a gap formed by two flanges and have roller tracks on both sides thereof against which are supported rollers of the bracing frame capable of taking up compressive forces; at least one bracing frame disposed between two opposite supports, which bracing frame can be guided in a vertically displaceable manner by means of parts engaging in the second guide channels; and lining plates which can be guided in a vertically displaceable manner in the first guide channels of two adjacent supports; wherein at least one pulley assembly is mounted in the upper region of the bracing frame, wherein said pulley assembly engages the vertical support through said second guide channel, and wherein the pulleys are disposed on horizontal axes inside and outside of said second guide channel. The pulley assembly comprises pairs of rollers on both sides of the pulleys wherein said rollers roll on the inside flanges of the second guide channel and on roller tracks of the vertical support outside of the second guide channel, thereby permitting the bracing frame to be vertically displaceable along the length of the vertical supports.

10 Claims, 3 Drawing Sheets

II
II
2
3
20
11
12
21
1
19
21
20
5
4
10
6
18
13
5'
17
14
18
13
2

1
2
3
4
5
6
7
8
9
10
11
12
15
16
19
20
22
23

LINING DEVICE

BACKGROUND OF THE INVENTION

The invention concerns a device for timbering or lining deep trenches, holes, tunnels or other excavations.

Lining devices are described in DE 4,230,860 and DE 4,404,812. In these devices, supports and support flanges are comprised of sheet steel. The lining plates are supported on the support flanges on one side, and on the other side by bracing frames standing crosswise in the trench. The bracing frames have upper and lower pairs of rollers which roll on roller tracks located on the supports so that the bracing frame and/or the supports can be moved relative to one another for raising or lowering the device into the trench. The bracing frames engage the supports via a guide channel arranged in the center of the inside (trench-facing side) of the supports. The roller tracks are formed by the outsides of the support flanges and extend on both sides of this guide channel.

When the device is in place in the trench, tensile forces may be exerted on the bracing frame by the supports, thus, the guide channel is partially enclosed by flanges on the inside of the support. The flanges define a gap between them through which parts of the bracing frame can fit thereby engaging the flange from behind, so that a form-fitting guide is achieved. In devices of this type, the parts engaging in a form-fitting manner in the guide channel are T-shaped rails, whose flanges slide on the inside of the flanges of the guide channel.

It has been shown that in devices for lining deep trenches, not only very high compressive forces are exercised on the bracing frame, but also very high tensile forces, which must be taken up by parts of the bracing frame that engage the flanges of the guide channel from behind. These forces are particularly great in the upper region of the bracing frame, if, when the pair of supports is driven into the earth, these parts do not stand precisely parallel to one another, but rather their lower ends stand at a shorter distance from one another than their upper ends. These tensile forces induce such large friction forces, that a shifting of the bracing frame relative to the supports is difficult.

SUMMARY OF THE INVENTION

The invention provides an improved lining device for lining walls, such as the walls of a trench, hole, tunnel or other excavation in the earth, comprising vertical supports for holding planar lining plates or boards and a bracing frame which sits crosswise in the trench or other excavation to brace the supports and lining plates. The device of the present invention utilizes a unique configuration which permits the bracing frame to be guided vertically and easily into the vertical supports even when large tensile forces are present.

The invention comprises vertical supports, which are designed to be arranged opposite one another in pairs along the walls of the trench or other excavation at substantially equal distances, said supports having an outside surface adapted to face the walls of the trench, an inside surface adapted to face the trench opening, and two lateral sides joining the inside and outside surfaces, which two lateral sides face the adjacent supports and are perpendicular to the trench walls. The supports comprise first guide channels on both sides adapted for receiving lining plates or boards. The supports each comprise on the inside surface facing the trench opening a second guide channel for receiving and guiding the support-engaging portion of the bracing frame. At the inside surface facing the trench opening, the second guide channel defines a gap space formed by two oppositely disposed flanges. Roller tracks are disposed flanking both sides of the flanges of the second guide channel, said roller tracks being adapted to support rollers of the bracing frame.

The invention further comprises at least one bracing frame, which is capable of being disposed between two supports of a support pair located on opposite sides of the trench, thereby spanning the trench in a crosswise manner. The bracing frame engages the supports through the second guide channels, whereby a portion of the bracing frame is adapted to engage and be guided in a vertically displaceable, form-fitting manner in the second guide channels of the supports. The bracing frame comprises at least two sets of rollers that rotate around at least two axes arranged at a distance from one another. One set of inside rollers in designed to fit within the second guide channel and to roll on the flanges forming the gap space of the second guide channel; and the second set of outside rollers is designed to roll on the roller tracks of the supports flanking the gap on the inside, trench-facing surface of the supports. Both sets of rollers serve to guide the bracing frame and keep it engaged with the supports when either the supports or the bracing frame is raised or lowered.

The invention further comprises lining plates whose edges can be guided in a vertically displaceable manner in the first guide channels of two adjacent supports disposed on one side of the trench, thereby forming the lining.

The present lining device has at least one pulley assembly which engages through the gap into the second guide channel. The pulley assembly comprises at least two, and preferably at least three, pulleys which turn around horizontal axes in the upper regions of the bracing frame on both sides facing the supports. The "upper" region of the bracing frame is the portion which is closest to the top of the trench when the device is in place. The horizontal axes are designed to be disposed both inside and outside of the second guide channel thereby to turn the rollers which roll inside and outside of the second guide channel to guide the bracing frame through the second guide channel. In a preferred embodiment, the pulley assembly has a triangular configuration in which two pulleys turn two horizontal axes within the second guide channel, and one pulley turns a horizontal axis outside of the second guide channel. Each pulley is connected to the others by a continuous pulley belt, such that all rotate simultaneously. Each of the horizontal axes have rollers disposed on either side the pulleys. The inside rollers roll on the insides of the flanges of the second guide channel, and the outside rollers roll along the roller tracks on the support flanking the second guide channel. The pulleys are mounted on the bracing frame so that they can be disposed through the second guide channel. Due to space constraints, small-diameter rollers preferably are utilized for the inside rollers which fit into the second guide channel, however, the rollers together can absorb large forces. The turning axis for the outside pulleys may coincide with the axes of the outside rollers that transmit compressive forces.

BRIEF DESCRIPTION OF THE DRAWINGS

In the description below, the embodiments of the invention will be explained in more detail with reference to the drawings.

DETAILED DESCRIPTION OF THE INVENTION

Figure 1:
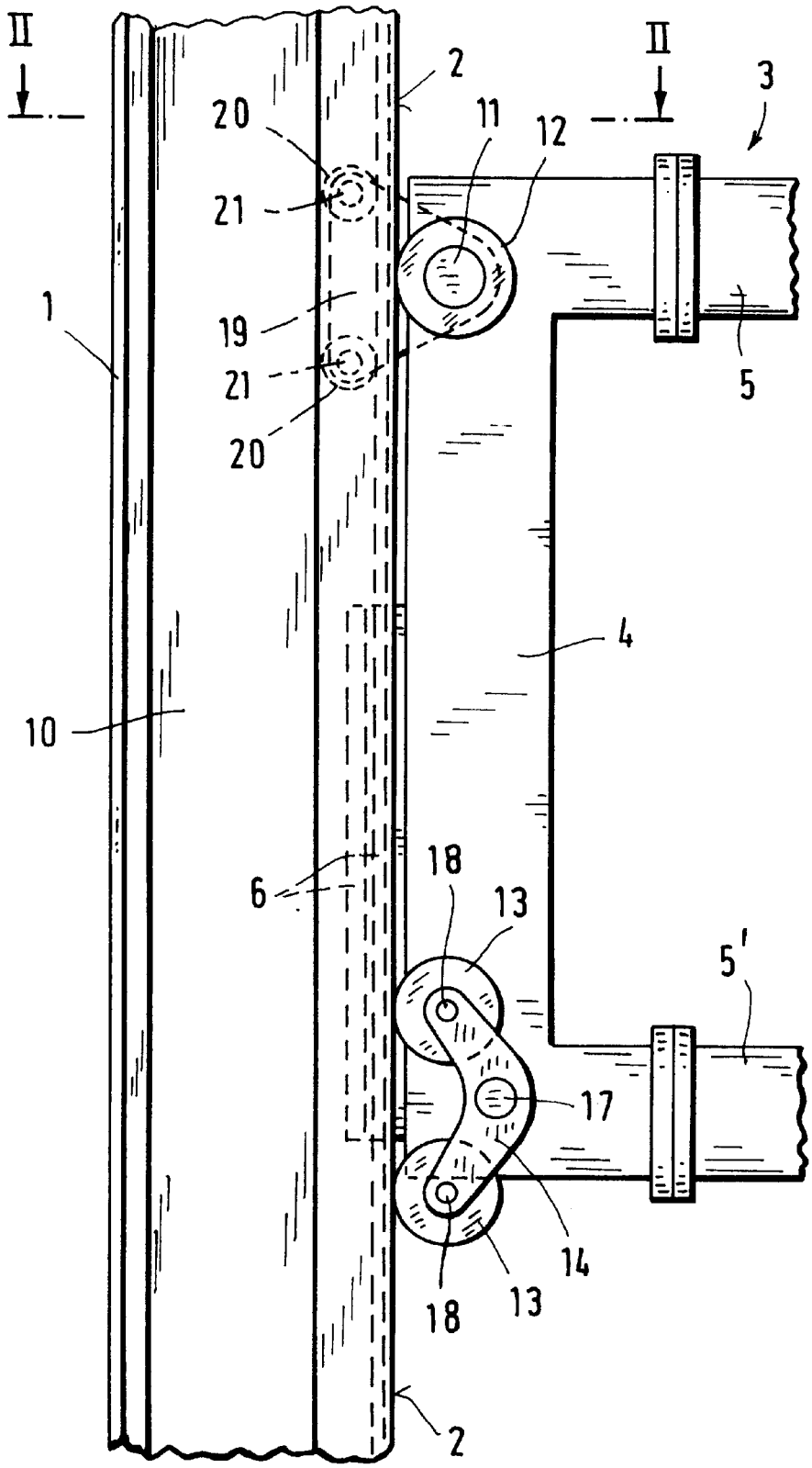
FIG. 1 shows a partial longitudinal view of one support and a bracing frame of a lining device according to the invention.

FIG. 1 shows a partial longitudinal view of a preferred embodiment of a bracing frame engaged with a support of the present invention. As shown in FIG. 1, pulley assembly 19 preferably has the shape of a triangle and comprises at least two sets of pulleys and rollers rotatable about at least two axes which are disposed within the second guide channel of support 1. In the preferred embodiment shown in FIG. 1, two pulleys and two pairs of rollers 20 turn around two horizontal axes 21, and one outside pulley and one pair of rollers 12, turn around axis 11. In one angle region of pulley assembly 19, the pulley is mounted so that it can turn on axis 11 of bracing frame 3, and axes 21 are configured to hold the two pairs of inside rollers 20 in the two other angle regions. The pulleys are connected by a belt. The bracing frame is guided in the second channel guide in a form-fitting manner in the lower region by means of T-shaped rail 6 which slides in the second guide channel.

In this embodiment, bracing frame 3 comprises two oppositely disposed vertical lateral struts 4, which are rigidly joined with each other by means of upper cross strut 5 and lower cross strut 5'. At the level of upper cross strut 5, rollers 12, which take up compressive forces and roll on roller tracks 2 of supports 1 are mounted so that they rotate around horizontal axis 11. Pulley assembly 19 preferably is coupled to bracing frame 3 so that it can turn around axis 11; however, in an alternative embodiment, the outside pulley of pulley assembly 19 may turn around a different axis than rollers 12.

At the level of lower cross strut 5', cradle 14 is mounted around turning axis 17. Cradle rollers 13 are mounted at the free ends of cradle 14, and rotate around axes 18. Cradle rollers 13 also roll on roller tracks 2 of support 1.

Figure 2:
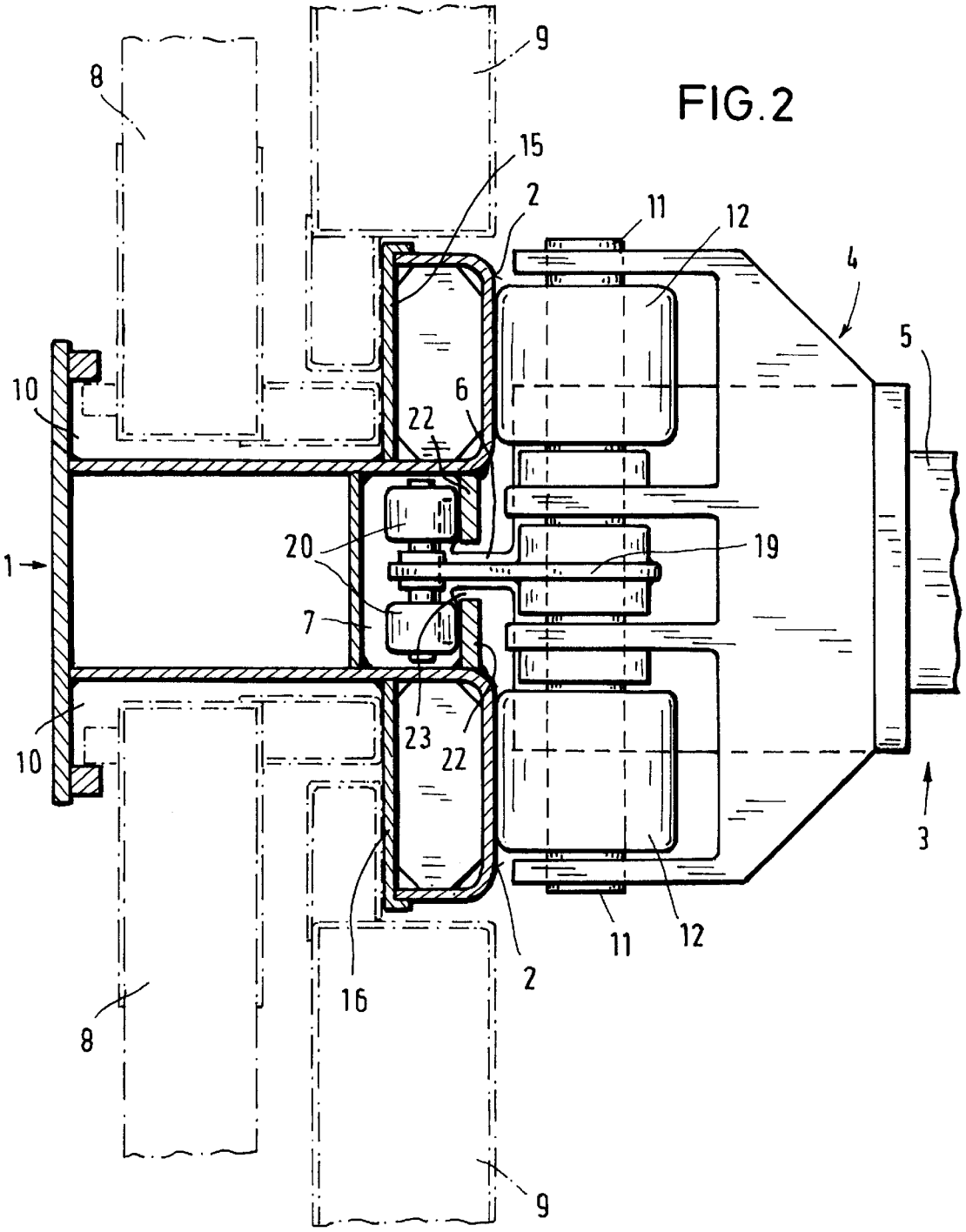
FIG. 2 shows on overhead cross-sectional view along intersecting line 11—11 in FIG. 1

FIG. 2 is a cross-sectional view from the top of a preferred embodiment of the present invention. As shown in FIG. 2, vertical support 1 of the lining device comprises first guide channel 10 on either side in which a lining plates 8 and 9 may be guided in a form-fitting manner. Outer lining plate 8 and inner lining plate 9 are supported on support flanges 15 and 16 of support 1. On the inside trench-facing surface, support 1 comprises two roller tracks 2, on which rollers 12 and 13 of bracing frame 3 are supported. Disposed between roller tracks 2 is second guide channel 7, which is partially enclosed by two flanges 22 defining gap 23 between them. Part 6 and inside rollers 20 of the bracing frame are engaged in a form-fitting manner through gap 23 such that inside rollers 20 roll on flanges 22. Pulley assembly 19 is mounted and connected so that the outside pulley turns around axis 11 and engages support 1 via the inside pulleys in second guide channel 7 through gap 23. Rollers 20, which roll around axes 21 and roll on the inside surface of flanges 22, are mounted on the same horizontal axes as the inside pulleys of pulley assembly 19 in second guide channel 7.

Figure 3:
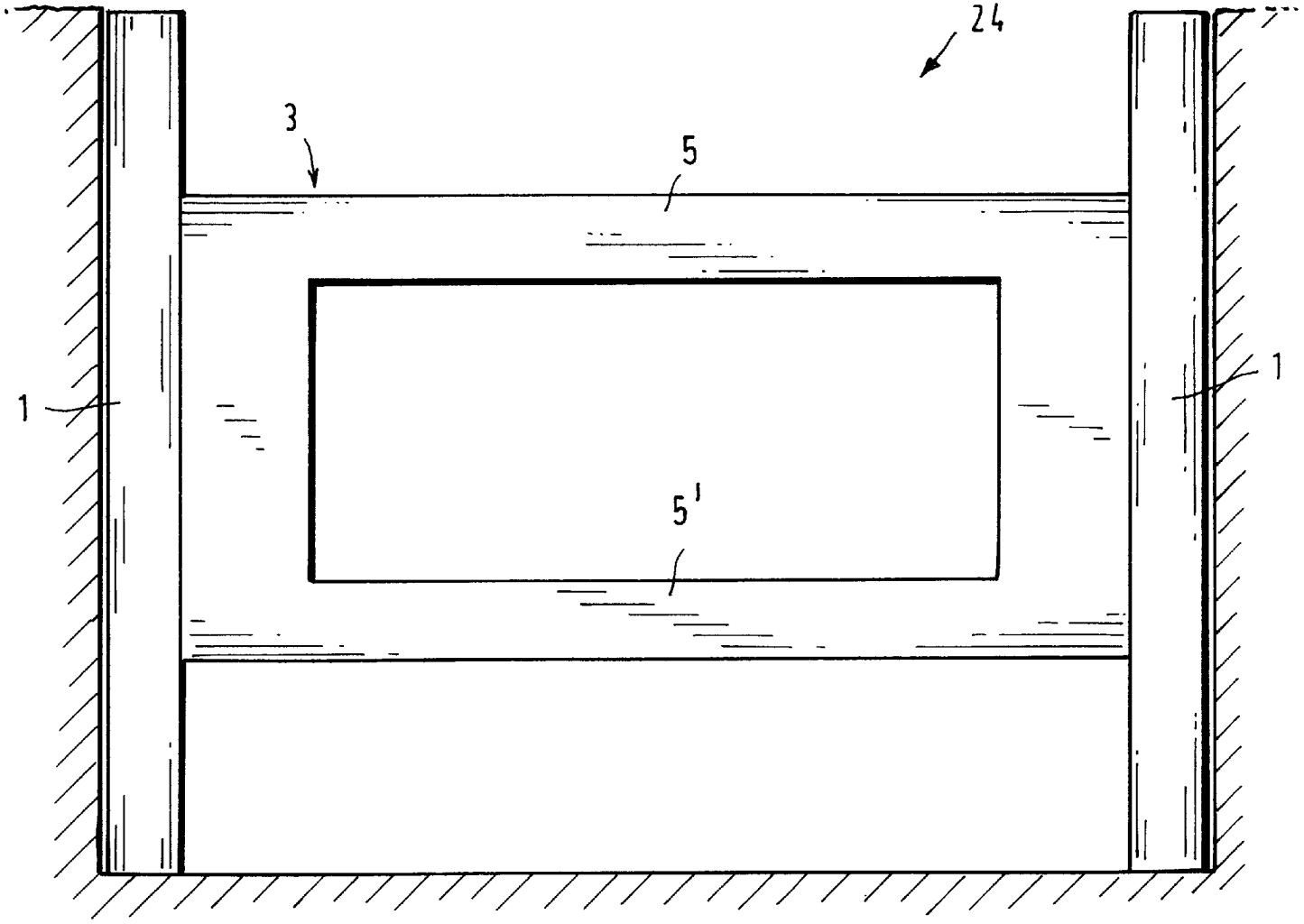
FIG. 3 is a schematic view showing the placement of the device of the present invention in a trench.

FIG. 3 provides a schematic, cross-sectional view of a trench having disposed therein a preferred lining device of the present invention. As shown in FIG. 3, disposed in trench 24 is the present device comprising vertical supports 1 disposed on opposite walls of the trench joined by bracing frame 3. Bracing frame 3 comprises horizontal cross struts 5 and 5'. The lining device lines and supports the walls of the trench, hole, or other excavation and permits the bracing frame to engage the supports and move vertically along the supports even in the presence of tensile forces.

Equivalents

Ons skilled in the art will be able to ascertain many equivalents to the embodiments described herein. These equivalents are intended to be encompassed within the scope of the following claims.

I claim:

1. A lining device for lining a trench, hole, tunnel or other excavation, said device comprising:

vertical supports adapted to be disposed in pairs opposite one another on each side of the trench, said vertical supports comprising an outside surface, an inside surface, and two lateral sides, said supports comprising first guide channels on each lateral side for receiving lining plates, and a second guide channel on the inside surface capable of receiving a bracing frame, wherein the second guide channel comprises two flanges which define a gap and inside roller tracks on the inner faces of the flange, said vertical support further comprising outside roller tracks flanking the flanges;

at least one bracing frame disposed between two opposite supports on opposite sides of the trench, wherein said bracing frame is capable of being guided in a vertically displaceable manner in the second guide channels of the supports, said bracing frame comprising at least two pairs of rollers rotatable around at least two axes arranged at a distance from one another, wherein said rollers comprise pairs of inside rollers which roll on the inside roller tracks of the second guide channels, and at least one pair of outside rollers which roll on the outside roller tracks of the supports when the bracing frame or the supports are raised or lowered; and lining plates comprising edges which are capable of being guided in a vertically displaceable manner into the first guide channels of two adjacent supports on one side of the trench;

wherein at least one pulley assembly is mounted on the bracing frame, said pulley assembly being capable of engaging the vertical support through the second guide channel, wherein said pulley assembly comprises pulleys which turn around horizontal axes disposed inside and outside of the second guide channel.

2. The lining device according to claim 1, wherein the axis of the outside pair of rollers of the bracing frame serve as the turning axis of the outside pulley.

3. The lining device according to claim 1, further comprising a cradle capable of turning around a horizontal axis, said cradle being disposed in a lower region of the bracing frame, wherein on free ends of the cradle at substantially the same distance from the axis and parallel to it, cradle rollers are mounted that run on the outside roller tracks of the supports.

4. The lining device according to claim 1 wherein the pulley assembly comprises three sets of pulleys rotatably connected by an endless pulley belt.

5. The lining device according to claim 4 comprising two pairs of inside rollers and one pair of outside rollers, wherein two of the pulleys are disposed on the same axes as the two pairs of inside rollers, and the outside pulley is disposed on the same axis as the pair of outside rollers.

6. An improved lining device for lining a trench, hole, tunnel or other excavation, said device comprising:

vertical supports adapted to be disposed in pairs opposite one another on each side of the trench, hole, tunnel or other excavation, said vertical supports comprising first guide channels on each lateral side for receiving lining plates, a second guide channel on the inside surface capable of receiving a bracing frame, and outside roller tracks disposed adjacent to the second guide channel;

at least one bracing frame adapted to be disposed between two of the vertical supports on opposite sides of the trench, wherein said bracing frame is capable of being guided in a vertically displaceable manner in the second guide channels of the supports, said bracing frame comprising a pulley assembly capable of engaging with the vertical supports through the second guide channel, said pulley assembly comprising at least two pulleys rotatable around at least two axes, at least two pairs of rollers disposed laterally on either side of the pulleys on said axes, wherein, when the pulley assembly is engaged in the second guide channel, at least one of the axes having disposed thereon a pulley and a pair of inside rollers is disposed inside of the second guide channel, and at least one of the axes having disposed thereon a pulley and a pair of outside rollers is disposed outside of the second guide channel.

7. The device of claim 6 wherein the pair of inside rollers are adapted to roll on the inside roller tracks of the second guide channel, and the pair of outside rollers are adapted to roll on the outside roller tracks of the supports.

8. The lining device according to claim 6, further comprising a cradle capable of turning around a horizontal axis, said cradle being disposed in a lower region of the bracing frame, wherein on free ends of the cradle at substantially the same distance from the axis and parallel to it, cradle rollers are mounted that run on the outside roller tracks of the supports.

9. The lining device according to claim 6 wherein the pulley assembly comprises three sets of pulleys rotatably connected by an endless pulley belt.

10. The lining device according to claim 9 comprising two pairs of inside rollers and one pair of outside rollers, wherein two of the pulleys are disposed on the same axes as the two pairs of inside rollers, and the outside pulley is disposed on the same axis as the pair of outside rollers.

* * * * *